United States Patent [19]

Restall

[11] Patent Number: 4,530,885

[45] Date of Patent: Jul. 23, 1985

[54] NICKEL OR COBALT ALLOY COMPOSITE

[75] Inventor: James E. Restall, Camberley, England

[73] Assignee: The Secretary of State for Defence in Her Britannic Majesty's Government of the United Kingdom of Great Britain and Northern Ireland, England

[21] Appl. No.: 367,740

[22] Filed: Apr. 12, 1982

Related U.S. Application Data

[63] Continuation of Ser. No. 171,406, Jul. 23, 1980, abandoned.

[30] Foreign Application Priority Data

Jul. 25, 1979 [GB] United Kingdom ..... 7925846

[51] Int. Cl.[3] ..... B32B 15/00

[52] U.S. Cl. ..... 428/670; 420/438; 420/443; 420/446; 420/447; 420/588; 428/680

[58] Field of Search ..... 420/443, 446, 447, 588, 420/438; 428/670, 678, 680; 148/425, 428, 442

[56] References Cited

U.S. PATENT DOCUMENTS 4,054,723 10/1977 Higginbotham et al. ..... 420/443
4,214,042 7/1980 Wilson ..... 420/438

*Primary Examiner*—R. Dean
*Attorney, Agent, or Firm*—Cushman, Darby & Cushman

[57] ABSTRACT

An alloy having the nominal composition Ni—30/40 wt % Cr—1/5 wt % Ti—2/8 wt % Al is used for coating gas turbine components to give protection against oxidation—and sulphidation—corrosion. A specific alloy having the composition Ni—37 Cr—3 Ti—2Al is applied to a blade fabricated from a nickel superalloy by sputter ion plating to give an overlay coating up to 100 μm thick. Preferably a platinum intermediate layer is flashed on to the substrate before coating. The coating alloy can additionally include rare earths, hafnium or silicon.

8 Claims, No Drawings

NICKEL OR COBALT ALLOY COMPOSITE

This is a continuation of application Ser. No. 171,406 filed July 23, 1980, now abandoned.

This invention relates to nickel/cobalt-base alloys (ie alloys in which nickel and cobalt are mutually interchangeable) more particularly for use in coating articles constituting components of gas turbine engines such as nozzle guide vanes and turbine blades so as to improve their corrosion resistance at operating temperatures.

Early heat resistant nickel-base alloys for turbine blades include a high percentage of chromium (eg 20 wt %) and rely principally on the formation of chromium oxide scale for corrosion resistance. Such alloys have good resistance to both oxidation and sulphidation attack.

More recent alloys intended to meet more severe working conditions imposed through higher engine performance and the need for increased service life have changed compositions and their chromium content may be as low as 5%.

The corrosion resistance of alloys of this nature is relatively low and in general it is necessary to resort to protective coatings.

There is a wide range of materials and processes which can be used to produce coatings on gas turbine aerofoils. The broad property requirements include:

High resistance to oxidation-and/or sulphidation-corrosion damage.

Adequate ductility to withstand changes in substrate dimensions without cracking.

Compatibility with base alloys in terms of constitution and thermal expansion.

Ease of application.

Coatings produced by so-called pack-aluminising processes are widely used and, to a lesser extent, coatings produced by the broadly similar chromising and siliconising processes. Aluminide coatings have very good oxidation resistance at temperatures up to 1100° C. Chromised coatings have good resistance to sulphidation at temperatures up to approximately 800° C. but do not have significant thermal stability in contact with oxygen-bearing atmoshperes ≧850° C. Silicon-enriched coatings also have a restricted temperature capability.

Aluminide coatings however tend to be susceptible to sulphidation attack which is undesirable in gas turbine engines employed in marine environments where sea salt accelerated corrosion can be severe, the processes of degradation by contaminated hot gas streams being numerous and often complicated.

Such processes involve diffusion interaction with substrate alloys and this may detract from the mechanical properties of the latter, in particular by reducing the load-bearing cross-sectional area which can be very significant in the case of thin-wall components such as turbine blades with internal cooling passages, or at leading and trailing edge regions. In castings having wall thickness of the order of 1 mm some 30° C. in creep rupture properties can be lost from this cause.

Overlay coatings such as may be deposited by physical vapour deposition (pvd) methods, although they require limited diffusion between coating and substrate to facilitate good bonding, do not rely on diffusion interaction for the formation of the coating itself and loss of mechanical properties is minimal. They are also more ductile than nickel- or cobalt-aluminide coatings at low temperatures, viz below 800° C.

Alloys suitable for use as overlay coatings on nickel-base materials can be produced having a very good resistance to sulphidation corrosion.

One alloy according to the invention has a composition within the range Ni/Co—30/40 wt % Cr—1/5 wt % Ti—2/8 wt % Al.

According to one aspect of the invention there is provided an article comprising a nickel-base substrate and an overlay coating of an alloy having the composition Ni/Co—30/40 wt % Cr—1/5 wt % Ti—2/8 wt % Al.

A thin layer of platinum or other precious metal may be deposited on the substrate prior to the overlay coating.

Another alloy according to the invention has a composition within the range Ni/Co—20/40 wt % Cr—1/5 wt % Ti—2/8 wt % Al—1/10 wt % Si.

By way of example, an alloy having the composition Ni—37 Cr—3Ti—2Al is prepared by mixing the constituents in powder form in the required proportions and melting together under vacuum and vacuum casting by a known conventional process. The alloy is applied to a gas turbine blade fabricated from a nickel-base alloy having the nominal composition Ni—13.5/16% Cr—0.9/1.5% Ti—4.2/4.8% Al—18/22% Co—4.5/5.5% Mo—0.2% C by sputter ion plating at a rate of the order 5-10 μm per hour to give an overlay up to 100 μm thick. In this process, inert gas ions (usually argon) from a plasma (glow) discharge in a low pressure chamber are accelerated under high voltage to the surface of a cathode formed of the coating alloy. Momentum interchange in the surface atom layers of the target (where the binding energy is lowest) causes ejection or "sputtering" of atoms or atom clusters of the material which are deposited on the substrate to be coated, this being suitably positioned to achieve maximum collection efficiency. An advantageous feature of the sputtering process is that the substrate can first be effectively cleaned by application of a negative bias to help ensure proper bonding of the coating. The efficiency of sputter depositions can be improved by using a lower negative bias to accelerate ions of coating material to the substrate. The composition of the basic alloy can be varied by substituting cobalt for nickel either completely or in direct proportion.

Components formed of alloys having the nominal compositions: Ni—15%Cr—3.4%Ti—3.4%Al—8.5% Co—1.75% Mo—2.6% W—1.75% Ta—0.9% Nb—0.01%B—0.1% Zr—0.17% C; Ni—12.5%-Cr—9.0%Co—4.2Ti—3.2%Al—2.0%Mo—3.9% W—3.9% Ta—0.02%B—0.1%Zr—0.20%C have also been coated in this fashion.

The presence of dust or chemical unhomogenous particles on the substrate surface can lead to leader, or flake, defects in the overlay coating and to avoid this it is preferable to first deposit a thin (3-25 μm, but usually 15 μm) flash coating of nickel or platinum (or other precious metal such as rhodium having comparable properties). The contrast chemical interface thus obtained leads to an improved microstructure in the overlay.

Other pvd processes suitable for depositing coatings of the above-mentioned alloys include arc-plasma spraying, electron beam evaporation and co-electrodeposition.

Overlay coatings of the composition specified have been found to possess significantly better ductility than aluminised coatings (which is important both from the aspect of fatigue failure and handling—nickel aluminide and cobalt aluminide coatings are brittle and care must be taken not to drop components or when tapping blades into a turbine disc) and have very good thermal shock resistance coupled with good thermal stability with respect to the substrates involved.

Overlay coatings of this nature have been subjected to gas streams containing 1 part per million of sea salt at temperatures of 750° C. and 850° C. and velocities up to 300 m/s for periods in excess of 1200 hours without measurable deterioration whereas various aluminised coatings have broken down under similar conditions after markedly shorter exposure, as little as 100 hours in certain cases.

The use of platinum as an intermediate layer has been found to be additionally advantageous in that it will dissolve into both substrate and overlay in the course of subsequent heat treatment operations to form a barrier which is highly resistant to crack propagation and so gives additional protection to the substrate from corrosion attack. Care must, however, be taken in choosing the conditions of subsequent heat treatment to ensure that the platinum does not react heavily with constituents of the coating alloy so as to impair oxidation corrosion resistance (as by the formation of discrete platinum enriched areas).

Such overlay coatings which can give comparable protection to that previously specified have the basic composition Ni—30/40%Cr—1/5%Ti—2/8%Al but with the addition of 0.1/3% of rare earths (Y, Ce, La etc).

The addition of up to 10 wt % silicon can give desirable properties though it may be desirable in some cases to reduce the proportion of chromium where amounts of silicon approach the upper limit. The range of composition will become Ni/Co—20/40 wt % Cr—1/5 wt % Ti—2/8 wt % Al—1/10 wt % Si. A typical alloy in this range has the composition Ni—30Cr—2Ti—8Al—5Si.

It can also be desirable to include up to 10% hafnium rather than silicon though the properties will naturally differ.

I claim:

1. A gas turbine engine component having an overlay coating and an intermediate layer between said component and said overlay coating, said coating being particularly resistant to sulphidation corrosion of the type experienced at 750° C., said coating having a composition consisting essentially of, in weight percent:

chromium: 30 to 40
titanium: 1 to 5
aluminum: 2 to 10
remainder selected from the group consisting of nickel, cobalt and nickel plus cobalt, and said intermediate layer not exceeding 25 μm of a metal selected from the group consisting of platinum, rhodium and nickel.

2. A gas turbine engine component having an overlay coating, the coating being particularly resistant to sulphidation corrosion of the type experienced at 750° C., said coating having a composition consisting essentially of, in weight percent:

chromium: 37
titanium: 3
aluminium: 2
remainder selected from the group consisting of nickel, cobalt and nickel plus cobalt.

3. A gas turbine engine component having an overlay coating and an intermediate layer between said component and said overlay coating, said coating being particularly resistant to sulphidation corrosion of the type experienced at 750° C., said cotating having a composition consisting of, in weight percent:

chromium: 30 to 40
titanium: 1 to 5
aluminum: 2 to 10
remainder selected from the group consisting of nickel, cobalt and nickel plus cobalt, and said intermediate layer not exceeding 25 μm of a layer metal selected from the group consisting of platinum, rhodium and nickel.

4. A gas turbine engine component having an overlay coating, the coating being particularly resistant to sulphidation corrosion of the type experienced at 750° C., said coating having a composition consisting essentially of, in weight percent:

chromium: 30
titanium: 2
aluminium: 8
silicon: 5
remainder selected from the group consisting of nickel, cobalt and nickel plus cobalt.

5. A gas turbine engine component according to claim 1, wherein the overlay coating contains from 0.1 to 3 weight percent of rare earth metal selected from the group consisting of yttrium, scandium and lanthanum.

6. A gas turbine engine component according to claim 1, wherein the overlay coating contains up to 10 weight percent hafnium.

7. A gas turbine engine component according to claim 1, wherein said overlay coating contains about 2 to about 8 weight percent aluminum.

8. A gas turbine engine component according to claim 3, wherein said overlay coating contains about 2 to about 8 weight percent aluminum.

* * * * *